US005505683A

United States Patent [19]

Geringer et al.

[11] Patent Number: 5,505,683

[45] Date of Patent: Apr. 9, 1996

[54] CENTRIFUGE BOWL GRIPPING APPARATUS HAVING A RETAINING ARM WITH A STATIONARY JAW AND A MOVEABLE JAW

[75] Inventors: Joseph Geringer, Winchester, Mass.; Laurence W. Tremaine, West Warwick, R.I.; Richard Miller, Braintree; Paul M. Volpini, Quincy, both of Mass.

[73] Assignee: Haemonetics Corporation, Braintree, Mass.

[21] Appl. No.: 165,357

[22] Filed: Dec. 10, 1993

[51] Int. Cl.[6] ..... B04B 7/06

[52] U.S. Cl. ..... 494/12; 494/41

[58] Field of Search ..... 494/12, 38, 41, 494/43, 84, 85; 269/126, 127, 254 R, 268, 270, 66

[56] References Cited

U.S. PATENT DOCUMENTS

| | | | |
|---|---|---|---|
| 636,383 | 11/1899 | Hartmann | 494/6 X |
| 3,073,517 | 1/1963 | Pickels et al. | 494/12 X |
| 3,317,127 | 5/1967 | Cole . | |
| 3,581,981 | 6/1971 | Latham, Jr. . | |
| 4,140,268 | 2/1979 | Lacour . | |
| 4,718,888 | 1/1988 | Darnell | 494/85 |
| 4,838,849 | 6/1989 | Calari | 494/85 |
| 4,889,524 | 12/1989 | Fell et al. | 494/12 |
| 5,104,372 | 4/1992 | Rossetto | 494/38 |
| 5,312,319 | 5/1994 | Salter | 494/12 |

*Primary Examiner*—Charles E. Cooley
*Attorney, Agent, or Firm*—Cesari and McKenna

[57] ABSTRACT

An apparatus for gripping a centrifuge bowl includes a single pivoting retaining arm having a stationary jaw. The retaining arm is capable of pivoting into and out of position such that the centrifuge bowl can be loaded and unloaded. A moveable jaw pivots about the retaining arm to lock the stem of the centrifuge bowl against the stationary jaw when actuated by a latching mechanism. At the same time, a catch on the latching mechanism locks the retaining arm to a latching shaft.

25 Claims, 7 Drawing Sheets

CENTRIFUGE BOWL GRIPPING APPARATUS HAVING A RETAINING ARM WITH A STATIONARY JAW AND A MOVEABLE JAW

BACKGROUND

Disposable blood processing centrifuge bowls include a rotary bowl body portion having a separation chamber for separating whole blood into constituent components. The rotary bowl body portion is commonly connected to a stem portion with a rotary seal. The stem portion includes an inlet port which allows whole blood to enter the centrifuge bowl and an outlet port which allows separated blood components to exit. The rotary seal allows the rotary bowl body portion to rotate independently of the stem portion so that the inlet and outlet ports can remain stationary.

Disposable centrifuge bowls require a chuck mechanism for securing the centrifuge bowl to the rotating mechanism during operation and a gripping mechanism for preventing rotation of the stem portion, for deflecting the rotary seal and for axially aligning the bowl in the chuck mechanism. Previous methods of securing centrifuge bowls within centrifuges have been time consuming and cumbersome. A common method of retaining the centrifuge bowl is by gripping the centrifuge bowl at a stem portion just below the inlet and outlet ports between two pivoting members. A locking device locks the two pivoting members together about the centrifuge bowl. See, for example, U.S. Pat. No. 4,889,524, FIG. 2, U.S. Pat. No. 3,581,981, FIG. 9 and U.S. Pat. No. 3,317,127, FIG. 7.

SUMMARY OF THE INVENTION

A drawback of gripping a centrifuge bowl with two pivoting members is that a number of steps must be performed in order to secure the centrifuge bowl. Each pivoting member must be independently swung into position about the centrifuge bowl while depressing the header of the centrifuge bowl and then locked in place with the locking device. This adds to the time required to perform a blood processing operation.

Accordingly, there is a need for an improved apparatus and method for gripping a centrifuge bowl which is easier and faster then previous attempts.

The present invention provides an apparatus for gripping a stem and flange of predetermined shape of a centrifuge bowl. The apparatus includes a moveable retaining arm having a stationary jaw and a moveable jaw. The retaining arm is moved into a position such that the stationary jaw engages the flange and stem when the bowl is properly secured in the chuck. A moveable jaw which is moveably secured to the retaining arm locks the stem of the centrifuge bowl against the stationary jaw.

In preferred embodiments, the retaining arm is supported by and pivots upon a support block about a first axis which allows the centrifuge bowl to be loaded and unloaded when the retaining arm is rotated out of the way. A latching mechanism opens and closes the moveable jaw into and out of gripping position. The moveable jaw pivots about a second axis located on the retaining arm. A first spring is secured to the moveable jaw and a cam block. An actuating member or pin on the handle of the locking mechanism engages the cam block and applies pressure to the moveable jaw via the cam block and spring to actuate movement of the moveable jaw. The first spring compensates for variations in size of the gripped portion of the centrifuge bowl. A catch affixed to the handle engages a latching shaft affixed to the support block for securing the handle to the latching shaft when the retaining arm is in a closed or gripping position. The flange is of polygonal shape and the stationary jaw is configured to provide orientation surfaces which mate with the flange such that the stem can be gripped only when the bowl is in an axially correct operating position. The centrifuge bowl includes a rotary seal located below the stem. The rotary seal has a curved upper surface or header which the retaining arm is positioned to engage and deflect downwardly.

The present invention provides a simple apparatus and method for gripping a centrifuge bowl. The gripping apparatus is capable of swinging into position and locking the centrifuge bowl into place with one easy motion of the hand. The gripping apparatus also deflects the rotary seal to proper deflection so that the inlet passageways of the seal are opened to admit fluid during operation.

BRIEF DESCRIPTION OF THE DRAWINGS

The foregoing and other objects, features and advantages of the invention will be apparent from the following more particular description of preferred embodiments of the drawings in which like reference characters refer to the same parts throughout the different views. The drawings are not necessarily to scale, emphasis instead being placed upon illustrating the principles of the invention.

DETAILED DESCRIPTION OF THE PREFERRED EMBODIMENTS

Figure 1:
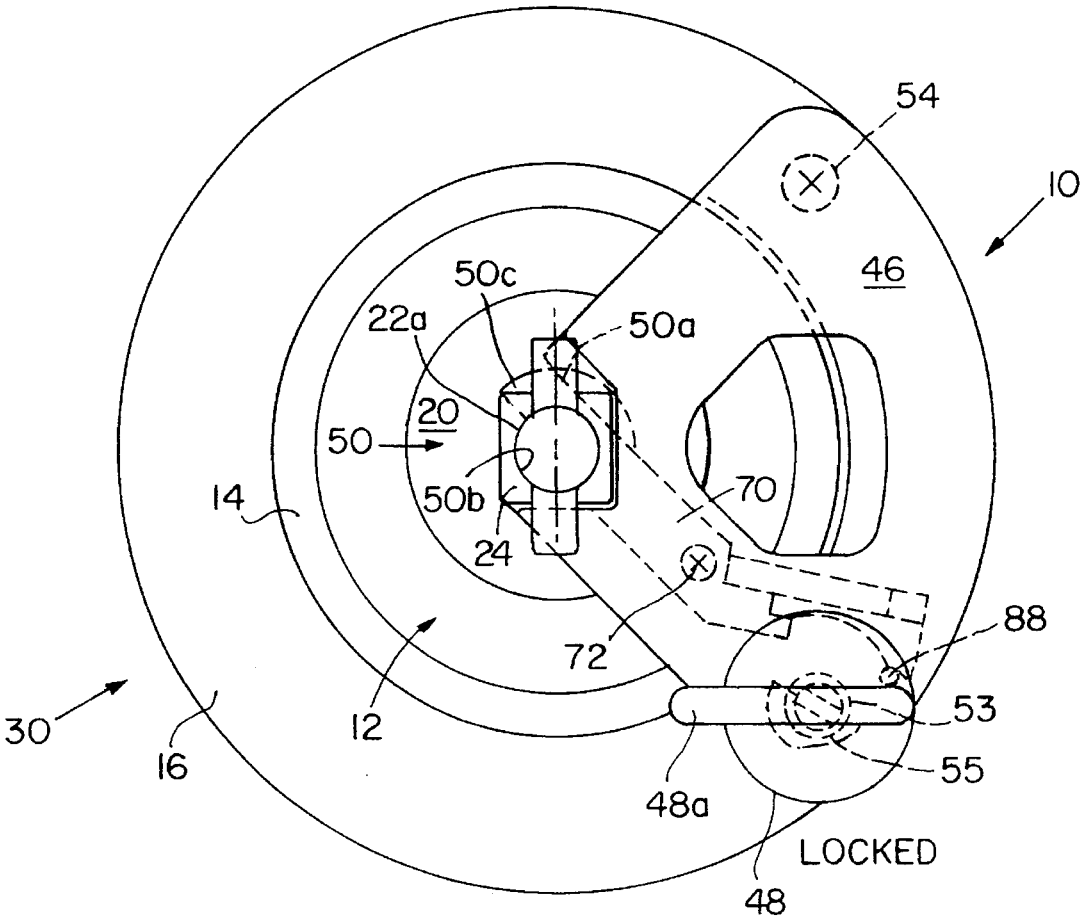
FIG. 1 is a top view of a centrifuge bowl within a centrifuge apparatus gripped by the present invention gripping apparatus.
Figure 2:
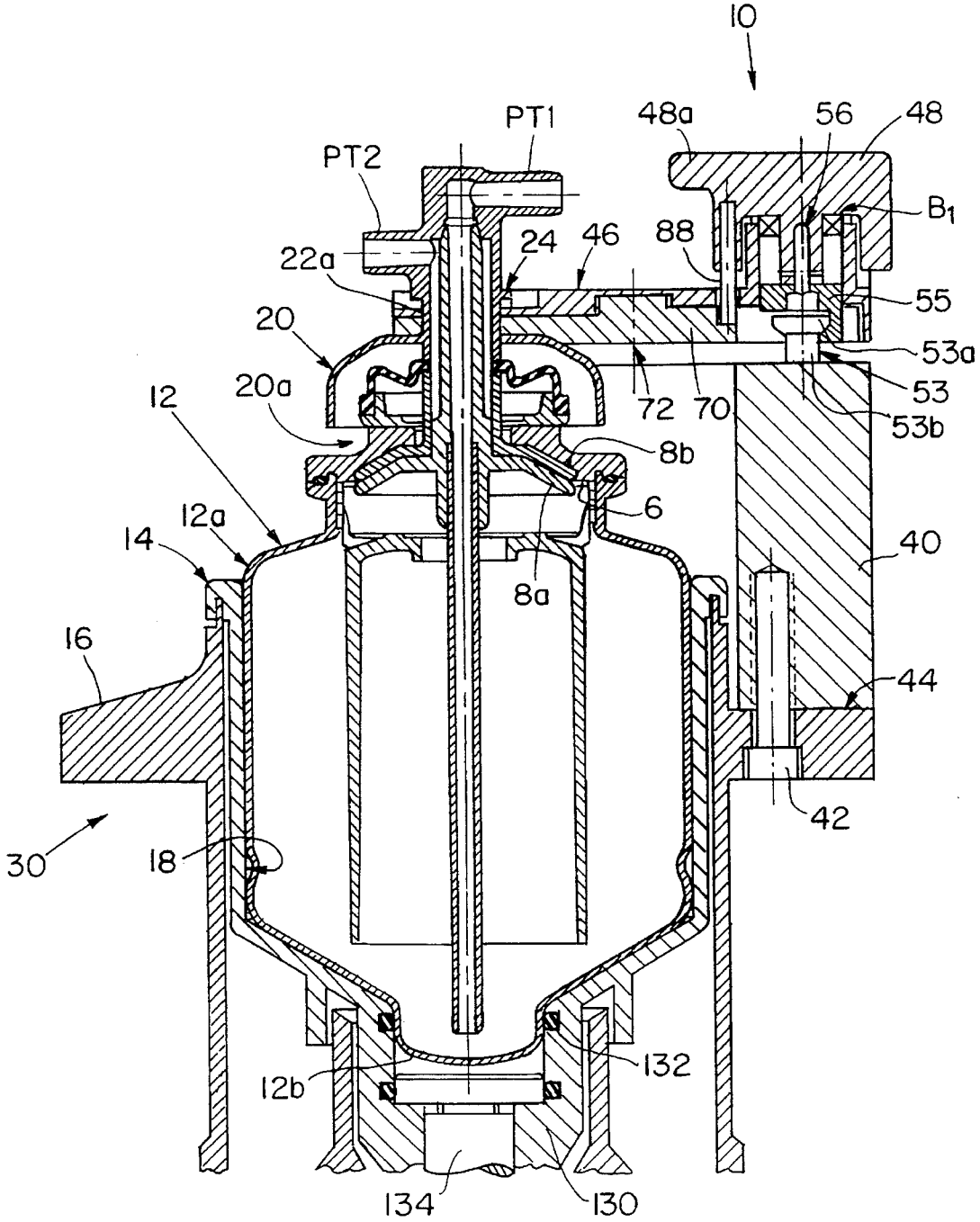
FIG. 2 is a side sectional view of a centrifuge bowl gripped by the present invention gripping apparatus.

Referring to FIGS. 1 and 2, rotary bowl 12*a* is held and rotated within cavity 18 of centrifuge 30 by chuck 130. Chuck 130 grips bottom portion 12*b* of centrifuge bowl 12 with "0" ring 132 and is powered by drive shaft 134. The portions of centrifuge bowl 12 above rotary bowl 2*a* extend beyond lip 14 of cavity 18.

Stem 22*a* (located between flange 24 and header 20) is held stationary by gripping apparatus 10 and holds centrifuge bowl 12 in proper axial alignment within cavity 18. Gripping apparatus 10 includes a support block 40 for supporting retaining arm 46 which is secured onto surface 44 of housing 16 with screws 42. Support block 40 is a curved segment contoured to surround a section of cavity 18.

Retaining arm 46 is secured to pivot shaft 54 which rotates upon bearings housed within support block 40. Retaining arm 46 deflects header 20 downward to open a passage 6 between skirts 8*a* and 8*b* of rotary seal 20*a*. This connects inlet and outlet ports PT1 and PT2 in fluid communication with rotary bowl 12*a*.

A latching mechanism 48 is provided with an integral handle 48*a*. Handle 48*a* is rotated to position gripping member 70 into gripping position. Gripping member 70 is pivoted about pivot point 72 and locks stem 22*a* against surface 50*b* within stationary jaw 50 of retaining arm 46. Catch 55, affixed to latching mechanism 48, captures latching shaft 53 to secure latching mechanism 48 to support block 40.

Figure 3:
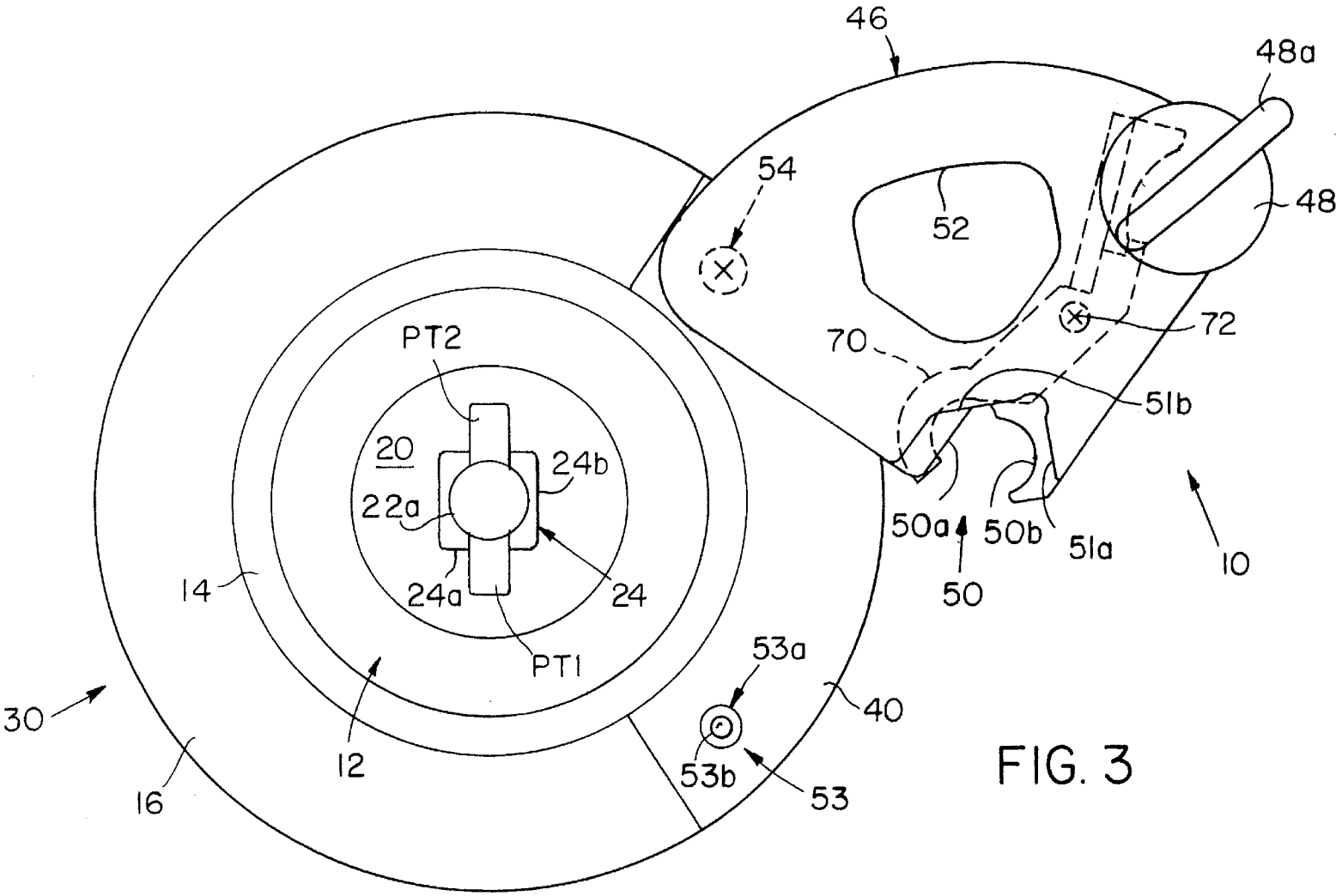
FIG. 3 is a top view of a centrifuge bowl within a centrifuge apparatus with the gripping apparatus pivoted in a loading position.

Referring to FIG. 3, in operation, retaining arm 46 is swung out of gripping position in order to load centrifuge bowl 12 into centrifuge apparatus 30. Retaining arm 46 is substantially triangular in shape with one side of the triangle being an arc. Pivot shaft 54, latching mechanism 48 and jaw 50 are located in respective corners of retaining arm 46.

Figure 4:
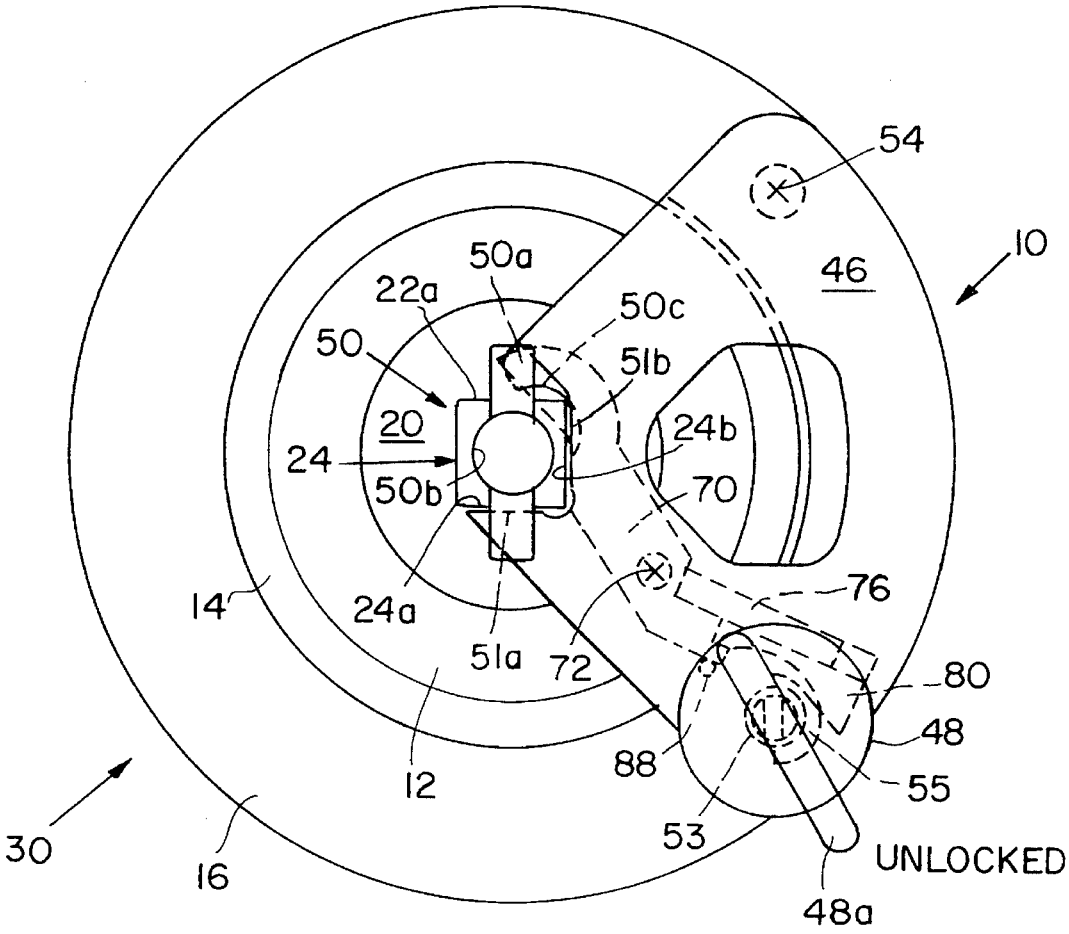
FIG. 4 is a top view of a centrifuge bowl within a centrifuge apparatus with the gripping apparatus in a gripping position with the jaws in an unlocked position.

Referring to FIG. 4, retaining arm 46 is swung into gripping position. The curved surface of header 20 acts as a ramp for retaining arm 46 as retaining arm 46 moves across the surface of header 20. This depresses header 20 downwards and opens passageway 6 between skirts 8*a* and 8*b* (FIG. 2) as previously discussed. As jaw surface 50*b* contacts stem 22*a*, orientation surfaces 51*a* and 51*b* engage surfaces 24*a* and 24*b* of flange 24, thereby orienting centrifuge bowl 12 in the proper operating axial orientation. As a result, centrifuge bowl 12 can only be gripped in a proper orientation. In the preferred embodiment, flange 24 is square. Alternatively, flange 24 can be of other suitable polygonal shapes.

Referring to FIG. 1, handle 48*a* of latching mechanism 48 is rotated in a clockwise direction to actuate gripping member 70 such that the curved inner surface of moveable jaw 50*c* captures stem 22*a* against stationary jaw surface 50*b*. At the same time, catch 55 captures latching shaft 53 (FIG. 2) to rigidly lock retaining arm 46 in place.

Figure 5:
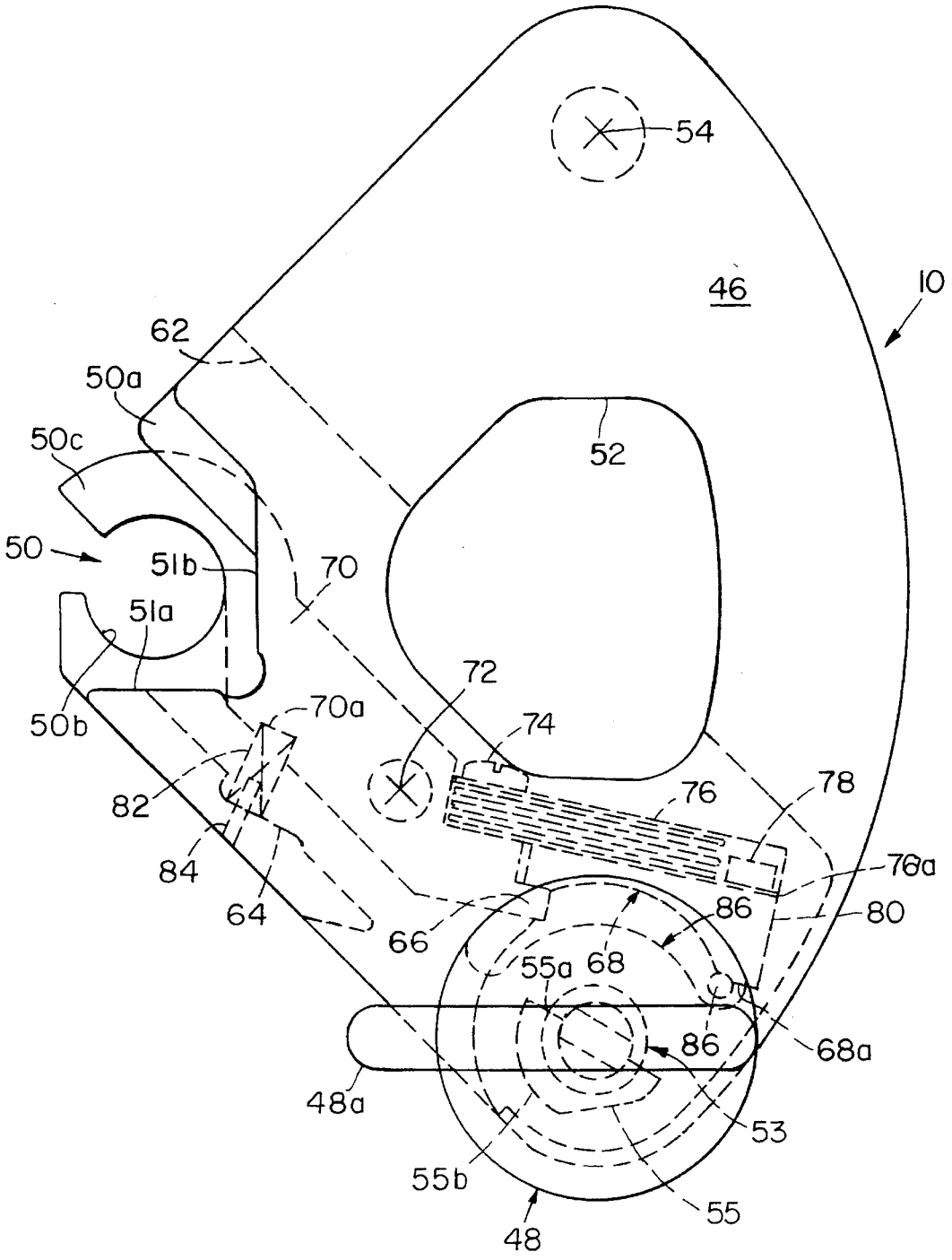
FIG. 5 is a top view of the present invention gripping apparatus.

A more detailed view of gripping apparatus 10 is depicted in FIG. 5. Retaining arm 46 has a single cavity 52 formed near the center of the arm to reduce the weight of the arm. Alternatively, multiple cavities 52 can be formed within retaining arm 46 or cavities can be omitted altogether.

Gripping member 70 is secured to the underside of retaining arm 46 within recessed area 62 by pivot 72. A stack of leaf springs 76 are secured to gripping member 70 by bolt 74. Leaf springs 76 sandwich cam block 80 against finger 66 of gripping member 70. The bottom spring 76*a* is longer than the other leaf springs and is secured to cam block 80 by screw 78. Leaf springs 76 can deflect to provide adjustment for moveable jaw 50*c* when in a closed position to compensate for any variations in the diameter of stem 22*a*. In the preferred embodiment, eight leaf springs 76 are employed to produce ten pounds of force on gripping arm 70. Alternatively, the number and stiffness of leaf springs 76 can be varied. Additionally, leaf springs 76 can be substituted for other suitable springs such as torsion springs, extension springs or compression springs.

Jaw surfaces 50*a* and 50*b* are located on the interior of jaw 50. Jaw surface 50*a* is angled to provide clearance between jaw surface 50*a* and stem 22*a* when retaining arm 46 is swung into gripping position. Jaw surface 50*b* is semicircular or arc shaped to form a mating surface for capturing stem 22*a*. Alternatively, jaw surface 50*b* can be of other suitable shapes such as a vee configuration.

Actuation pin 88 is affixed to latching mechanism 48 and travels within slot 86 of retaining arm 46. Actuation pin causes gripping member 70 to pivot by engaging curved cam surface 68 of cam block 80, thereby opening and closing moveable jaw 50*c*. Curved cam surface 68 ramps up to a tip 68*a*, at which point the moveable jaw 50*c* is rotated into a closed position. When actuation pin 88 reaches tip 68*a*, an audible and tactile click is experienced, signaling to the user that the moveable jaw 50*c* is in a closed position.

A compression spring 82 extending between surface 64 of recessed area 62 and gripping arm 70 applies pressure upon gripping member 70 in a clockwise direction. This helps urge moveable jaw 50*c* into an open position when latching mechanism 48 is in an unlatched position. Compression spring 82 is secured to surface 64 by pin 84 and gripping member 70 by hole 70*a*. Alternatively, spring 82 can be replaced with other suitable types of springs.

To open moveable jaw 50*c*, handle 48*a* of latching mechanism 48 is rotated in a counter-clockwise direction whereby pin 88 disengages from tip 68*a* and travels back down cam surface 68. Compression spring 82 applies pressure on gripping member 70 and rotates gripping arm 70 about pivot 72, thereby opening moveable jaw 50*c*. At the same time, catch 55 rotates to disengage from latching shaft 53. Retaining arm 46 can then be swung out of gripping position and centrifuge bowl 12 can be removed from centrifuge apparatus 30.

Figure 6:
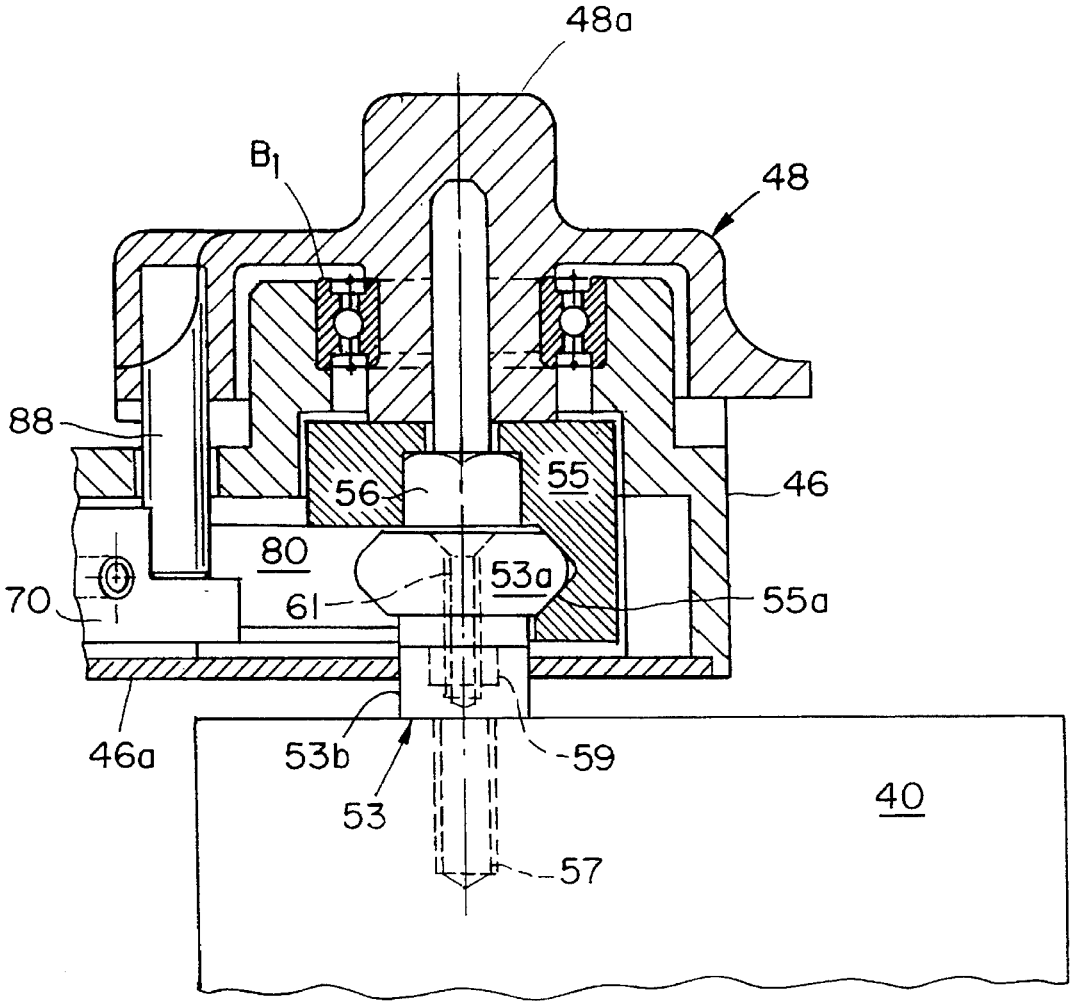
FIG. 6 is a side sectional view of the latching mechanism of the gripping apparatus shown in a locked position.

FIG. 6 depicts a more detailed view of latching mechanism 48 and latching shaft 53. Screw 56 attaches catch 55 to handle 48*a*. Latching mechanism 48 rotates relative to retaining arm 46 about bearing $B_1$. Splash guard 46*a* protects the components of retaining arm 46 from contaminants. In the preferred embodiment, bearing $B_1$ is a roller or ball bearing. Alternatively, bearing $B_1$ can be substituted with other suitable bearings such as needle bearings, bronze bushings or polymer bushings.

Latching shaft 53 includes a lower shaft portion 53*b* and an upper shaft portion 53*a* affixed together by screw 61. Neck 59 protrudes from upper shaft portion 53*a* and mates with a corresponding bore within lower shaft portion 53*b*. Both neck 59 and the corresponding bore are eccentric with the outer diameters of their respective shaft portions. This allows the horizontal position of upper shaft portion 53*a* to be adjusted by rotating the upper shaft portion 53*a* relative to the lower shaft portion 53*b*.

Upper shaft portion 53*a* has a double dovetail configuration which mates with a corresponding female cavity 55*a* within catch 55. The region of catch 55 which captures upper shaft portion 53*a* is substantially semicircular (FIG. 5) which allows retaining arm 46 to be swung into gripping position when latching mechanism 48 is in the unlatched position. Latching mechanism 48 must be in an unlatched position for retaining arm 46 to be swung into gripping position. If latching mechanism 48 is pivoted into a latched position before retaining arm is attempted to be swung into gripping position, the backside 55*b* (FIG. 5) of catch 55 will hit latching shaft 53, thereby preventing retaining arm 46 from moving completely into gripping position.

Threaded stud 57 of lower shaft portion 53*b* affixes latching shaft 53 to support block 40. Threaded stud 57 also provides vertical adjustment for latching shaft 53 depending upon the depth at which threaded stud 57 is screwed into support block 40.

Figure 7:
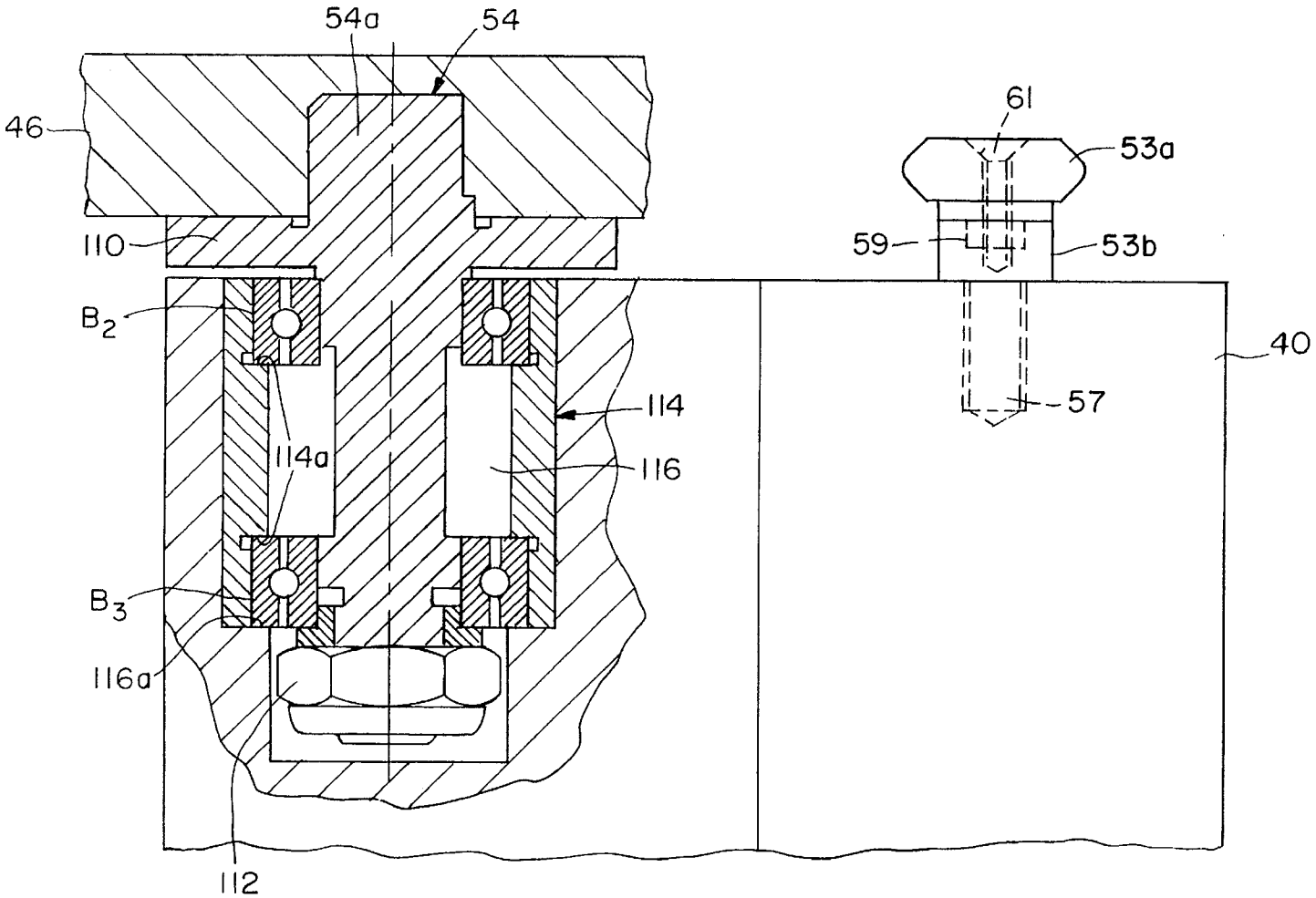
FIG. 7 is a partial sectional view of the pivoting mechanism for the retaining arm.

FIG. 7 depicts a more detailed view of the manner in which retaining arm pivots relative to support block 40. Retaining arm 46 is secured to neck 54*a* of pivot shaft 54 and rests against shoulder 110. Pivot shaft 54 rotates about ball bearings $B_2$ and $B_3$ which are housed within sleeve 114 and cavity 116. Sleeve 114 rests against shoulder 116*a* of cavity 116 within support block 40. Bearings $B_2$ and $B_3$ are separated from each other by shoulders 114*a*. Locknut 112 locks pivot shaft 54, bearing $B_2$, bearing $B_3$ and sleeve 114 together. Alternatively, a single bearing or bushing can replace bearings $B_2$ and $B_3$.

In the preferred embodiment, the components of gripping apparatus 10 are made of stainless steel. However, other suitable materials such as plastics or other metals can be used. Additionally, although gripping apparatus 10 is shown to be used for gripping bowls of a design similar to that disclosed in U.S. Pat. No. 4,983,158, gripping apparatus 10 can be used to grip bowls of other designs, including designs similar to U.S. Pat. No. 4,300,717.

Equivalents

While this invention has been particularly shown and described with references to preferred embodiments thereof, it will be understood by those skilled in the art that various changes in form and details may be made therein without departing from the spirit and scope of the invention as defined by the appended claims.

What is claimed is:

1. An apparatus for gripping a centrifuge bowl having a stem and a flange of predetermined shape, the apparatus comprising:

a retaining arm having a stationary jaw for engaging the stem;

a moveable jaw; and means for pivotably securing the moveable jaw to the retaining arm such that pivoting of the moveable jaw secures the stem between the stationary and moveable jaws.

2. The apparatus of claim 1 further comprising a first spring, secured to the retaining arm and to the moveable jaw, for urging the moveable jaw away from the stem.

3. The apparatus of claim 2 further comprising a latching mechanism affixed to the retaining arm for retaining the moveable jaw in fixed engagement with the stem.

4. The apparatus of claim 3 in which the latching mechanism comprises a cam block secured to the moveable jaw by a second spring that transmits force from the cam block to the moveable jaw.

5. The apparatus of claim 4 in which the latching mechanism further comprises:

a rotatable handle; and a member secured to the handle and communicating with the cam block such that rotation of the handle causes the cam block to revolve about a first pivot so as to rotate the moveable jaw in opposition to the urging by the first spring.

6. The apparatus of claim 5 further comprising:

a support block for supporting the retaining arm;

a latching shaft affixed to the support block; and a catch affixed to the handle for securing the handle to the latching shaft.

7. The apparatus of claim 6 in which the handle is configured such that rotation thereof to rotate the moveable jaw to secure the stem between the stationary and moveable jaws secures the catch to the latching shaft.

8. The apparatus of claim 4 wherein the second spring is disposed to allow relative angular motion between the moveable jaw and the cam block to accommodate the size of the stem.

9. The apparatus of claim 1 wherein the bowl has an outer circumference and wherein the stationary jaw is configured to provide orientation surfaces which mate with the flange at a predetermined circumferential orientation.

10. The apparatus of claim 1 in which the stationary jaw has an inner surface which is shaped to provide a mating surface which mates with the stem.

11. The apparatus of claim 1 further comprising:

a support block; and means for pivotably securing the retaining arm to the support block so as to facilitate engagement of the stationary jaw with the stem by pivoting the retaining arm.

12. An apparatus for processing blood, the apparatus comprising:

a centrifuge bowl having a stem and a flange of predetermined shape;

a retaining arm having a stationary jaw for engaging the stem;

a moveable jaw; and means for pivotably securing the moveable jaw to the retaining arm such that pivoting of the moveable jaw secures the stem between the stationary and moveable jaws.

13. The apparatus of claim 12 in which the centrifuge bowl has an outer circumference and wherein the stationary jaw is formed to provide orientation surfaces which mate with the flange at a predetermined circumferential orientation.

14. The apparatus of claim 12 further comprising a first spring, secured to the retaining arm and to the moveable jaw, for urging the moveable jaw into an open position.

15. The apparatus of claim 14 further comprising a latching mechanism affixed to the retaining arm for retaining the moveable jaw in fixed engagement with the stem.

16. The apparatus of claim 15 in which the latching mechanism comprises a cam block secured to the moveable jaw by a second spring that transmits force from the cam block to the moveable jaw.

17. The apparatus of claim 16 in which the latching mechanism further comprises:

a rotatable handle; and a member secured to the handle and communicating with the cam block such that rotation of the handle causes the cam block to revolve about a first pivot so as to rotate the moveable jaw in opposition to the urging by the first spring.

18. The apparatus of claim 17 further comprising:

a support block for supporting the retaining arm;

a latching shaft affixed to the support block; and a catch affixed to the handle for securing the handle to the latching shaft.

19. The apparatus of claim 18 in which the handle is configured such that rotation thereof to rotate the moveable jaw to secure the stem between the stationary and moveable jaws secures the catch to the latching shaft.

20. The apparatus of claim 16 wherein the second spring is disposed to allow relative angular motion between the moveable jaw and the cam block to accommodate the size of the stem.

21. The apparatus of claim 12 in which the stationary jaw has an inner surface which is configured to provide a mating surface which mates with the stem.

22. The apparatus of claim 12 in which the flange is of polygonal shape.

23. The apparatus of claim 12 in which the centrifuge bowl includes a rotary seal having a curved upper surface located below the stem, the retaining arm being shaped to engage and deflect downwardly the upper surface of the rotary seal when the stationary jaw engages the stem.

24. The apparatus of claim 12 further comprising:

a chuck for engaging a bowl portion of the centrifuge bowl.

25. The apparatus of claim 12 further comprising:

a support block; and means for pivotably securing the retaining arm to the support block so as to facilitate engagement of the stationary jaw with the stem by pivoting the retaining arm.

* * * * *